US007329865B2

(12) United States Patent
Kuypers

(10) Patent No.: US 7,329,865 B2
(45) Date of Patent: Feb. 12, 2008

(54) MASS SPECTROMETRY SYSTEM AND METHOD WITH WINDOW ASSEMBLY

(75) Inventor: Ned Robert Kuypers, Los Altos, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 253 days.

(21) Appl. No.: 11/274,454

(22) Filed: Nov. 14, 2005

(65) Prior Publication Data

US 2007/0108381 A1 May 17, 2007

(51) Int. Cl.
*H01J 49/04* (2006.01)

(52) U.S. Cl. ..... 250/288; 250/423 R

(58) Field of Classification Search ..... 250/288, 250/423 R
See application file for complete search history.

(56) References Cited

U.S. PATENT DOCUMENTS 5,753,795 A * 5/1998 Kuypers ..... 73/23.37

* cited by examiner

*Primary Examiner*—Kiet T. Nguyen

(57) ABSTRACT

A housing, mass spectrometry system, and system for aligning a capillary in an ion source includes a housing having a movable panel and a window. A capillary is associated with the housing and the window. When the panel is in an open position the window provides a line of sight for viewing and aligning the capillary to a defined position, and when the panel is in a closed position the capillary is aligned within the ion source.

20 Claims, 8 Drawing Sheets

MASS SPECTROMETRY SYSTEM AND METHOD WITH WINDOW ASSEMBLY

BACKGROUND

Gas chromatography is a process by which a substance may be separated into its constituent ions or molecules. Typically, the substance is dissolved in a solvent and is injected into a long, narrow gas chromatographic capillary tube coiled within a temperature-controlled chamber. The substance and the solvent are then vaporized, and a carrier gas (e.g., Helium or Hydrogen) exerts a force upon the vaporized substances, transporting them through the capillary column. The walls of the capillary column are chemically coated with a stationary phase material. The various components of the vaporized substances interact with the stationary phase material in differing manners, meaning that they pass through the capillary column at different rates.

Gas chromatography may be used as an initial phase prior to further analysis via instrumentation, such as a mass spectrometer. Per such an arrangement, a substance to be analyzed is first separated into its constituents by a gas chromatograph. Thereafter, time-sequenced gaseous samples are delivered from the output of the gas chromatograph to the input of the mass spectrometer, i.e., into the ion source of the mass spectrometer.

Transfer of the substances from the gas chromatograph to the mass spectrometer is typically conducted via a conduit. A portion of the capillary column runs through the conduit, and enters the ion source of the mass spectrometer. Positioning of the capillary column is an important factor for proper function of the mass spectrometry operation. Despite this, most mass spectrometers are arranged so that positioning of the capillary column is difficult to accomplish.

Given the foregoing, there exist opportunities for improving the ability of an operator of a mass spectrometry system to position the capillary column within the ion source.

SUMMARY OF THE INVENTION

In general terms, the present invention is directed to a mass spectrometry system that includes a housing that has a window permitting for view of a capillary as it protrudes from a conduit.

According to one embodiment an enclosure for aligning a capillary in an ion source includes a housing having a panel movable relative to the housing and a window. A capillary is associated with the housing and the window. When the panel is in an open position the window provides a line of sight for viewing and aligning said capillary to a defined position. When the panel is in a closed position the capillary is aligned within the ion source.

According to another embodiment, a mass spectrometry system includes an ion source. The mass spectrometry system also includes a housing associated with the ion source. The housing has a panel movable relative to the housing and a window. A capillary is associated with the housing and the window. When the panel is in an open position the window provides a line of sight for viewing and aligning said capillary to a defined position. When the panel is in a closed position the capillary is aligned within said ion source.

According to yet another embodiment, a system for aligning a capillary in an ion source includes a capillary and a window for viewing and aligning the capillary. A movable panel is associated with the capillary and window. When the panel is in an open position the window provides a line of sight for viewing and aligning the capillary to a defined position, and when the panel is in a closed position said capillary is aligned within an ion source.

According to yet another embodiment, a method of aligning a capillary in an ion source includes removing the ion source from a first location within a housing. A capillary is positioned at a defined location, so that the capillary is aligned in the ion source when the ion source is returned to the first location. The capillary is viewed through a window in the housing, while positioning the capillary.

DETAILED DESCRIPTION

Figure 1:
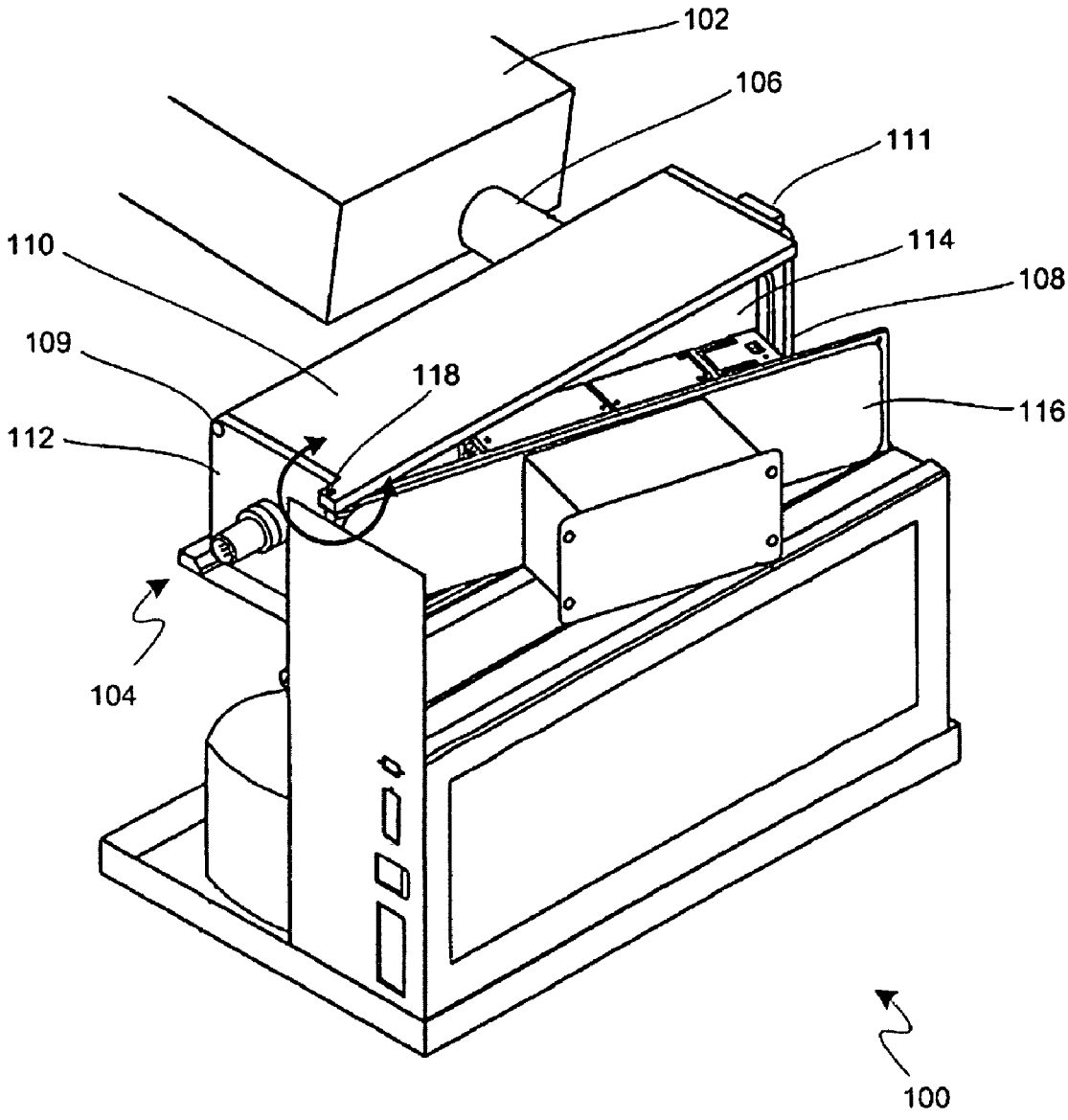
FIG. 1 depicts an exemplary embodiment of a gas chromatograph/mass spectrometer system.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

As used herein, the term "orthogonal" refers to a generally perpendicular relationship between bodies, axes, surfaces, and/or vectors. The term "distal," when used to describe an end of a conduit, refers to the end of the conduit remote from the ion source (e.g., an end of the conduit that is within a gas chromatograph). The term "proximal," when used to describe an end of a conduit, refers to the end of the conduit nearest the ion source (e.g., the end of the conduit that may abut the ion source). The term "capillary" refers to a conduit used in separating molecules via gas chromatography. The term "movable" refers to the capacity of a part, such as a panel, to be moved from its position within a structure, without disassemblage of any portion of the structure. The term "door" refers to a part of a housing that is movable and can provide access to the interior of a housing. The term "associated with," when used to describe a relationship between parts, refers to a structure in which the various parts cooperate to create a condition, function, state, and/or operation. The term "align" refers to the act of positioning an object at a desired location with respect to another object.

FIG. 1 depicts an example of a gas chromatograph/mass spectrometry system 100. The system 100 includes a gas chromatograph 102, which is coupled to a mass spectrometry system 104 via a conduit 106. The mass spectrometry system 104 includes a housing 109 defining a vacuum chamber 108 that is composed of various panels 110, 112, 114, and 116 that are sealed together during operation. Only some of the panels making up the vacuum chamber 108 are visible in FIG. 1. According to one embodiment, the panels are made of Aluminum or another suitable material.

According to one embodiment, panel 116 is coupled, in a manner permitting rotation, to the other panels by a hinge assembly 118. This panel 116 can be swung open and closed by an operator. One example of such a hinge arrangement is described in U.S. Pat. No. 5,753,795, entitled "DEMOUNTABLE VACUUM-SEALING PLATE ASSEMBLY," which issued to Ned R. Kuypers on May 19, 1998.

According to one embodiment, a window assembly 111 is connected to the housing. Various embodiments of the window assembly 111 are discussed below.

Figure 2:
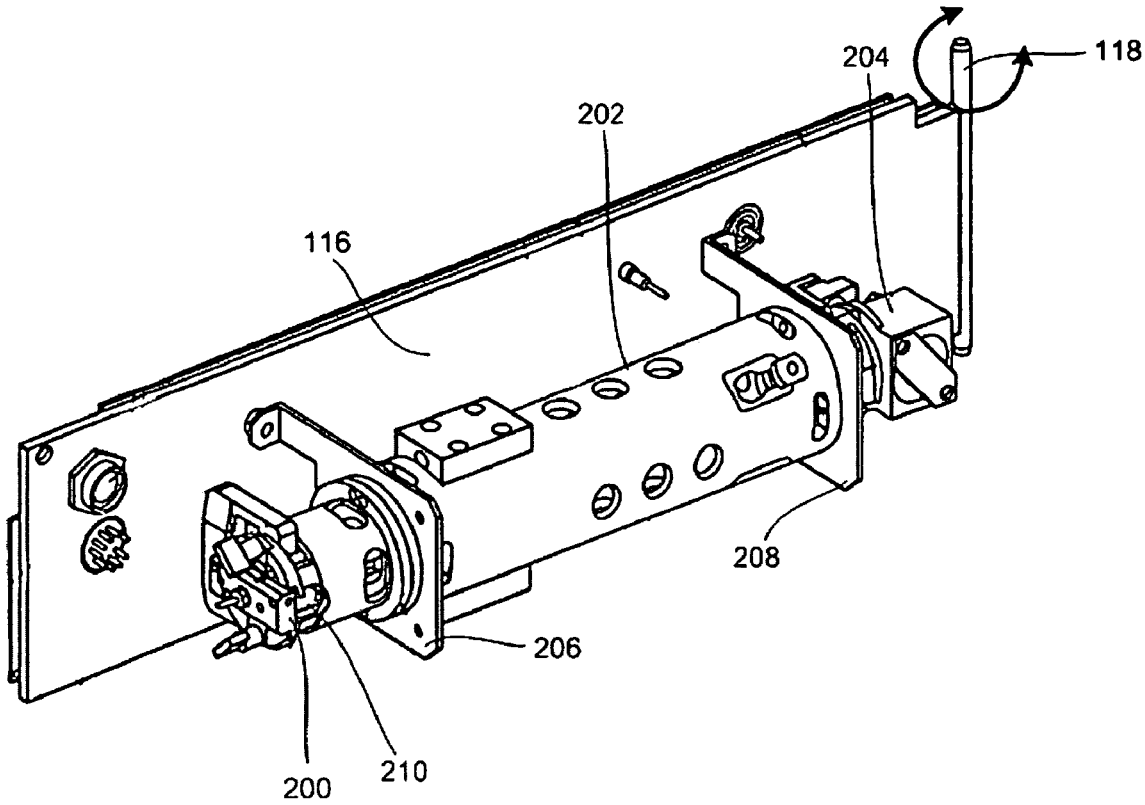
FIG. 2 depicts an ion source, quadrupole mass filter, and detector coupled to a hinged panel of a vacuum chamber.

FIG. 2 depicts the aforementioned hinged panel 116 from the other side. As can be seen from FIG. 2, an ion source 200, quadrupole ion mass filter 202 and a detector 204 are coupled to the hinged panel 116 by two brackets 206 and 208. Hence, when an operator swings the hinged panel 116 open, the ion source 200, quadrupole ion mass filter 202, and detector 204 rotate with the panel 116, and are removed from their respective positions within the interior of the vacuum chamber 108.

Figure 3:
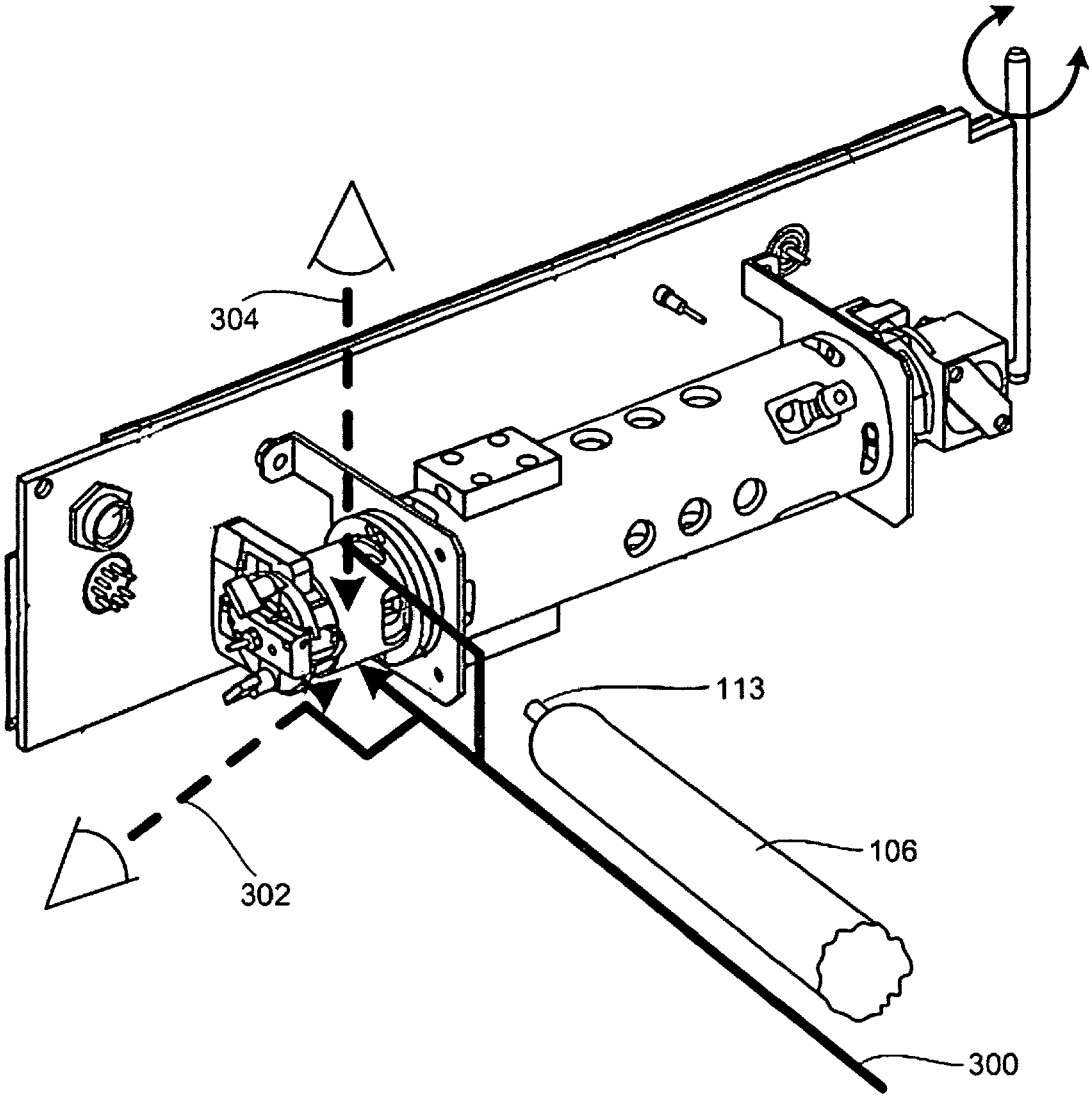
FIG. 3 depicts various lines-of-sight providing convenient visual feedback for adjustment of a capillary column.

The ion source 200 defines an input port 210. The conduit 106 penetrates the panel disposed opposite the hinged panel 116, and abuts the input port 210. A portion of the capillary column of the gas chromatograph 102 extends through the interior of the conduit 106, and protrudes from its proximal (relative to the ion source 200) end. The protruding portion of the capillary column enters the ion source 200 by way of the input port 210. The protrusion of the capillary column is not visible in FIG. 1, but is visible in FIG. 3, discussed in greater detail, below, but referenced now for its depiction of the conduit 106 and protruding capillary column 113. In FIG. 3, the protusion and relative dimensions of capillary column 113 are exaggerated for the sake of illustration.

Prior to operation of the mass spectrometry system 104, the extent of protrusion of the capillary column is adjusted, in order to ensure that the substances emanating therefrom are properly and efficiently ionized within the ion source. Before making such an adjustment, the ion source 200 is removed from its location within the interior of the vacuum chamber 108. In the context of a hinged vacuum chamber 108, such as the one depicted in FIGS. 1-3, the ion source 200 is removed by swinging the hinged panel 116 open.

Thereafter, the extent of protrusion of the capillary column is adjusted. With the hinged panel 116 open, an operator of the particular mass spectrometry system 100 depicted herein is able to view the protruding capillary column from a substantially end-on vantage, when looking through the orifice in the housing created by virtue of having opened the hinged panel 116. Such a vantage does not permit for convenient visual feedback regarding the extent of the protrusion of the capillary column from the transfer tube.

To permit convenient visual feedback, it is desirable to provide a vantage that permits for a line-of-sight that is substantially perpendicular to the direction in which the protrusion occurs. (Since the protrusion of the capillary column usually occurs along the same direction as the longitudinal axis of the conduit 106, the aforementioned line of sight is also usually substantially perpendicular to the longitudinal axis of the conduit 106). However, the line-of-sight need not be perpendicular to the direction in which the protrusion occurs. Instead, it is sufficient if the line-of-sight provides an operator a perspective from which the operator can determine the extent of the protrusion of the capillary column 113 from the conduit 106. Turning to FIG. 3, the direction of the protrusion/direction of the longitudinal axis of the conduit 106 is identified by solid line 300. Hence, to provide convenient visual feedback, lines of sight such as those identified by dashed lines 302 and 304 may be provided. For example, to provide a line-of-sight 302, a window assembly may be disposed on the front panel 114 of the vacuum chamber 104. On the other hand, to provide a line-of-sight 304, a window assembly may be disposed on panel 110 (i.e., the "top" panel), proximate to the location where the conduit 106 joins the vacuum chamber 108. In the exemplary embodiment, a window assembly may be disposed in any plane perpendicular to the plane defined by the intersection of lines-of-sight 302 and 304. In other embodiments, a window may be disposed at any location that provides an operator a perspective from which the operator can determine the extent of the protrusion of the capillary column 113 from the conduit 106.

Figure 4:
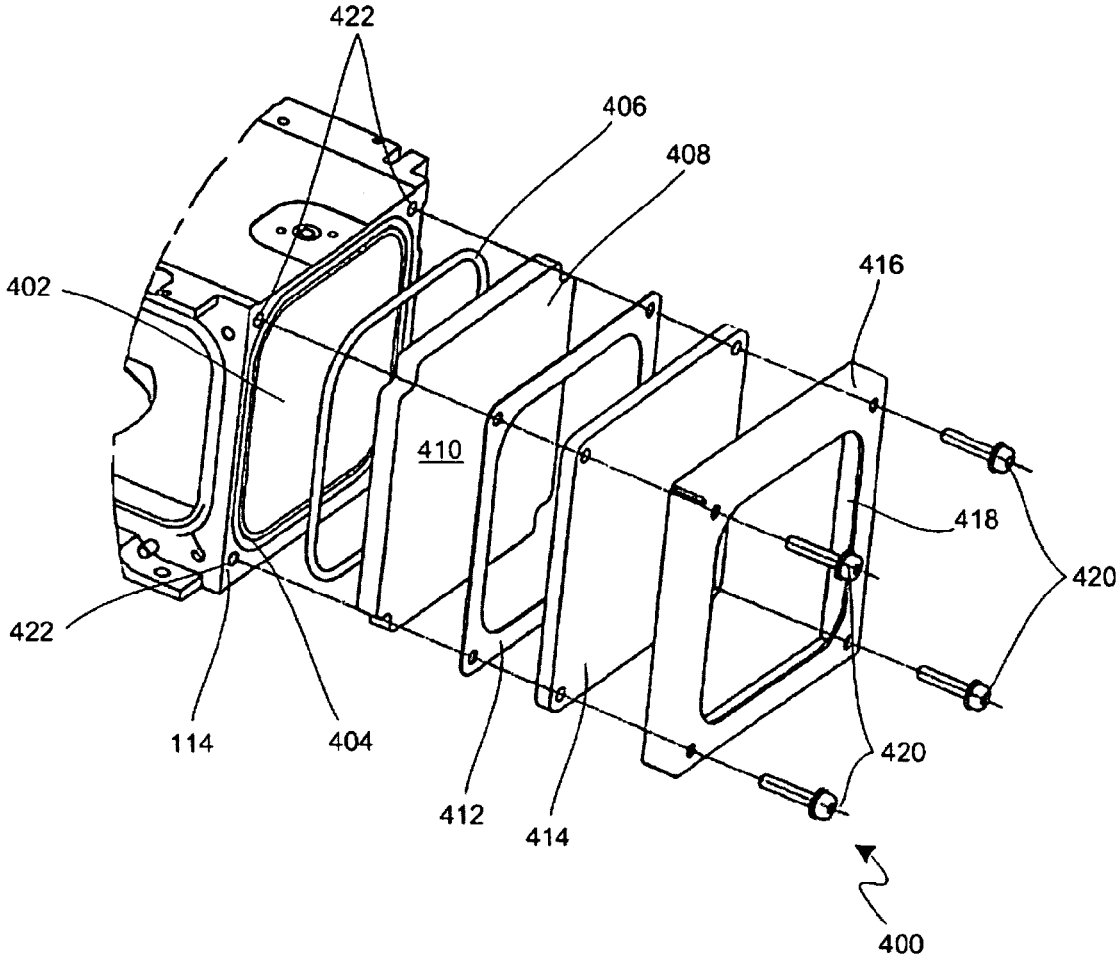
FIG. 4 depicts an exemplary embodiment of a window assembly.

FIG. 4 depicts a window assembly 400 that is disposed on the front panel 114 of the vacuum chamber 104. As just stated, according to another embodiment, this window assembly 400 may be disposed on panel 110, proximate to the location where the conduit 106 joins the vacuum chamber 108.

As can be seen from FIG. 4, the front panel 114 defines a void 402 to which the window assembly 400 is adjoined. Around the periphery of the void 402 is a recess 404. The recess 404 is dimensioned for reception of an o-ring 406. The o-ring 406 creates a seal between the rear panel 114 and an inner window 408.

The inner window 408 defines a viewing surface 410. The viewing surface 410 extends along a vector that is substantially parallel to the direction in which the capillary column protrudes from the conduit 106. (Stated another way, the viewing surface is substantially parallel to the longitudinal axis of the conduit 106.) Therefore, the line-of-sight provided by the inner window 410 is substantially perpendicular to the direction of the protrusion of the capillary column from the conduit 106, thereby providing convenient visual feedback.

According to one embodiment, the inner window 408 is made of heat-tempered borosilicate glass. In the event that Hydrogen is the carrier gas employed by the gas chromatograph 102, it is, for example, possible under certain gas mixture and pressure conditions that the electron stream (or "beam") delivered by the ion source 200 could cause an explosion. Under many conditions, heat-tempered borosilicate glass is strong enough to contain such an explosion.

A gasket 412 is interposed between the inner window 408 and an outer window 414. The gasket 412 prevents the inner and outer windows 410 and 414 from abutting one another. This is useful in the context of embodiments in which the outer window 414 is made of a different material than the inner window 410. According to one embodiment, the outer window 414 may be made of clear polycarbonate or another suitable material. The outer window 414 serves as a safety measure. In the event of a Hydrogen explosion within the ion source 200, the inner window 410 could shatter under some conditions. The outer window 414 serves the purpose of containing the inner window 410, should the inner window 410 shatter. Since the outer window 414 may be made of a different material than the inner window 410, an optical aberration may occur if the two windows 410 and 414 are abutted. Specifically, optical fringe patterns may be generated. Thus, according to these embodiments, the gasket 412 prevents the occurrence of such aberrations. According to yet other embodiments, the gasket 412 and outer window 414 are absent.

The window assembly 400 also includes a frame 416, which may be made of sheet metal or other suitable material, for example. The frame 416 defines a recess 418 into which the inner window 410, gasket 412, and outer window 414 are received. The frame 416 is joined to the front panel 114. For example, according to one embodiment, the frame 416 is joined to the front panel 114 by four threaded fasteners 420 that extend through each corner of the frame 416, and mate with threaded holes 422 defined in the front panel 114.

Figure 5:
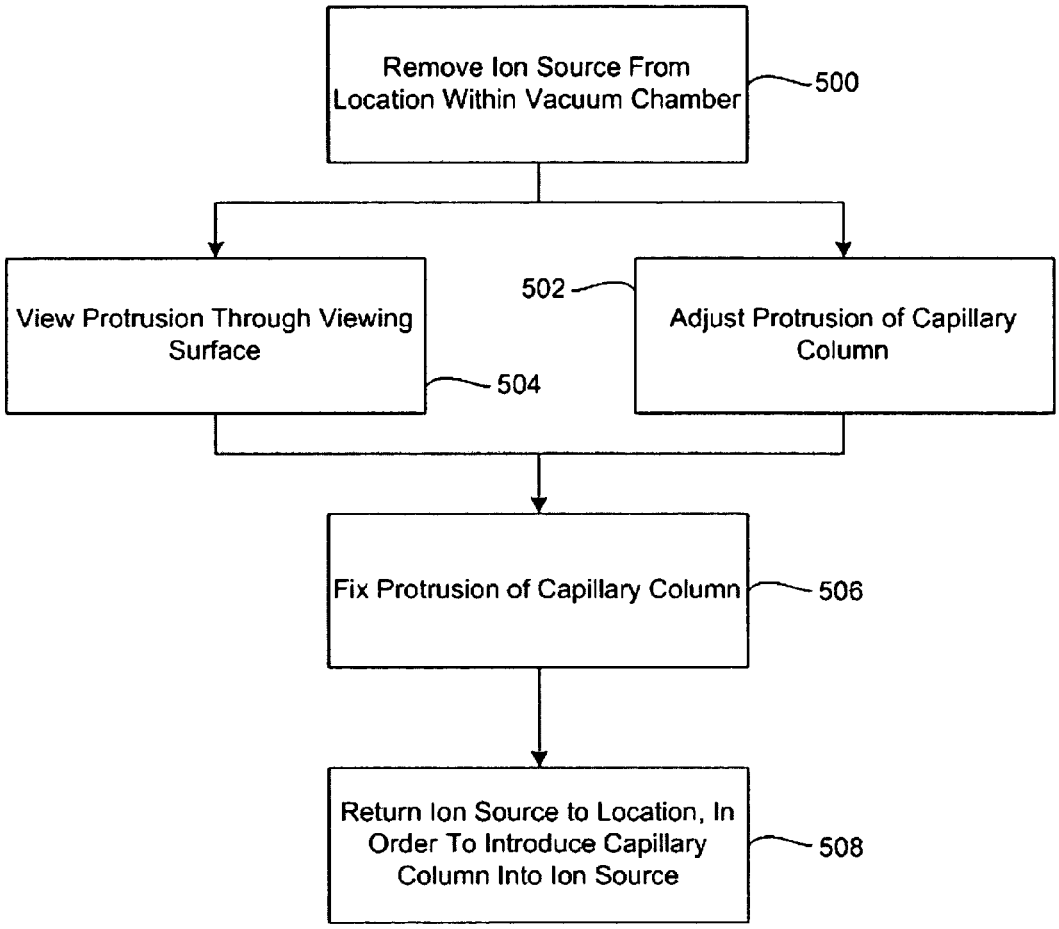
FIG. 5 depicts an exemplary method by which the protrusion of a capillary column may be adjusted.

To adjust the capillary column according to the embodiments herein, the method depicted in FIG. 5 may be carried out. Initially, the ion source 200 may be removed from its location within the vacuum chamber 108, as shown in operation 500. According to some embodiments, operation 500 is accomplished by swinging open a hinged panel 116 to which the ion source 200 is coupled.

Figure 6:
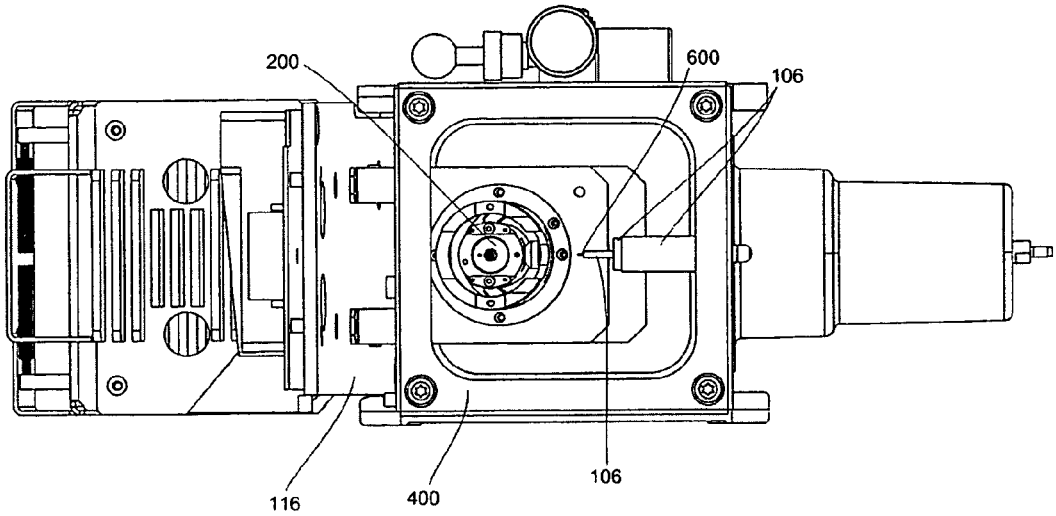
FIG. 6 depicts an exemplary embodiment of a mass spectrometer having a window assembly and a hinged panel that is in an opened position.
Figure 7:
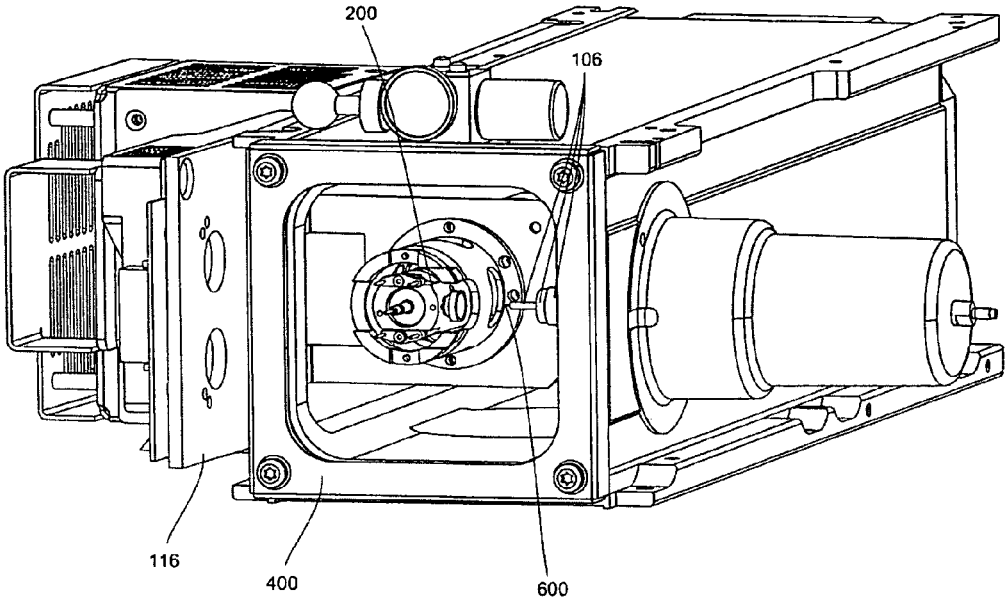
FIG. 7 depicts a three-dimensional view of the mass spectrometer of FIG. 6.

Next, the extent of the protrusion of the capillary column from the conduit 106 is adjusted to the desired length, as shown in operation 502. To allow for such adjustment, the operator may view the protruding capillary column (operation 504) through a viewing surface in accordance with the principles described with reference to FIGS. 1-4, while the operator performs the adjustment process 502. FIG. 6 depicts an exemplary embodiment of the mass spectrometer with its hinged panel 116 opened, so that the ion source 200 is removed from its original location within the vacuum chamber. (For the sake of illustration, the repeller heater block has been removed from the mass spectrometer of FIG. 6, as the repeller heater block would obstruct the view of the ion source 200. Otherwise, the view shown is that which is observed when an operator views the interior of the mass spectrometer through the window assembly 400.) Also shown in FIG. 6 is the capillary column 600 protruding from the conduit 106 (the exemplary conduit shown in FIG. 6 includes several coaxial layers, which are jointly referred to as "the conduit," and identified by reference numeral 106). To assist the reader, FIG. 7 depicts a three-dimensional view of the depiction shown in FIG. 6.

Thereafter, the protruding capillary column may be locked into place, so that its position remains fixed, as shown in operation 506. According to some embodiments, operation 506 is carried out by sealing the capillary column to the conduit 106, using a capillary column compression seal fitting.

Figure 8:
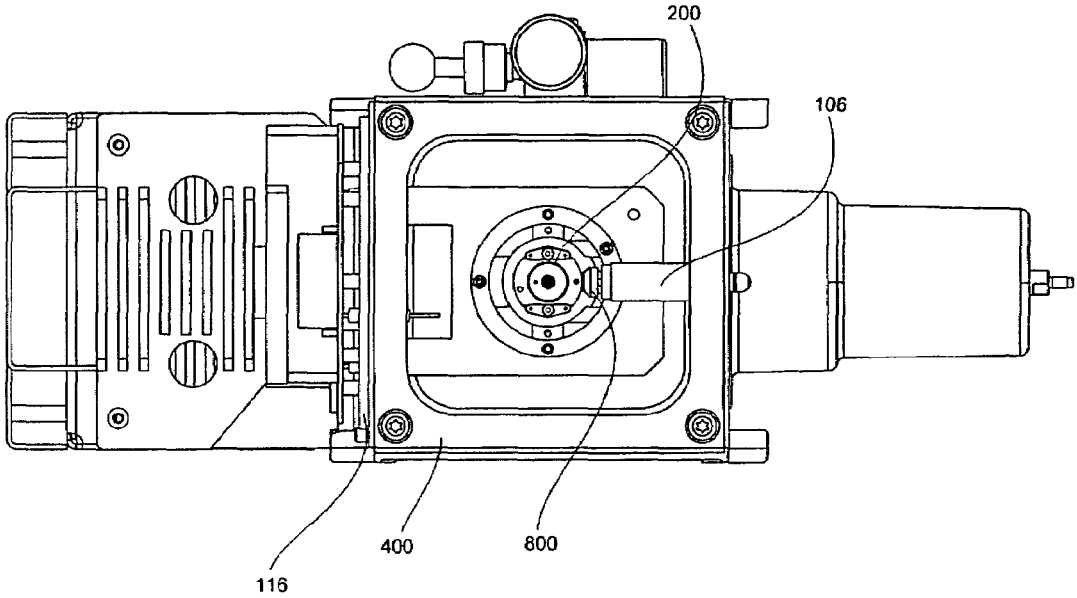
FIG. 8 depicts an exemplary embodiment of a mass spectrometer having a window assembly and a hinged panel that is in a closed position.

Finally, the ion source 200 is returned to its original location within the vacuum chamber 108, in a manner that permits introduction of the protruding portion of the capillary column into the input port 210 of the ion source 200, as shown in operation 508. According to some embodiments, operation 508 is accomplished by swinging closed a hinged panel 116 to which the ion source 200 is coupled. FIG. 8 depicts an embodiment of the mass spectrometer with its hinged panel 116 in the closed position. As can be seen, the conduit abuts a conical guide 800, which introduces the capillary column (not visible in FIG. 8) into the input port of the ion source. The interior surface of the conical guide 800 is formed in a funnel-like fashion. Therefore, as the hinged panel 116 is closed, the capillary column is introduced into the interior space of the conical guide 800, and follows the interior funnel-like surface, until the capillary column is guided through an orifice in the guide 800, and is thereby introduced into the input port of the ion source 200.

The various embodiments described above are provided by way of illustration only and should not be construed to limit the invention. Those skilled in the art will readily recognize various modifications and changes that may be made to the present invention without following the example embodiments and applications illustrated and described herein, and without departing from the true spirit and scope of the present invention, which is set forth in the following claims.

The invention claimed is:

1. An enclosure for aligning a capillary in an ion source, comprising:

a housing having a panel movable relative to the housing and a window; and a capillary associated with said housing and said window, wherein when said panel is in an open position said window provides a line of sight for viewing and aligning said capillary to a defined position, and when said panel is in a closed position said capillary is aligned within said ion source.

2. The enclosure of claim 1, wherein the window further includes a vacuum seal interposed between a first transparent layer and the housing.

3. The enclosure of claim 2, wherein the first transparent layer comprises borosilicate.

4. The enclosure of claim 2, wherein the window further includes a gasket interposed between the first transparent layer and a second transparent layer, so that viewing surfaces of the first and second layers do not contact one another.

5. The enclosure of claim 4, wherein the first transparent layer comprises borosilicate, and the second transparent layer comprises polycarbonate.

6. The enclosure of claim 1, wherein the panel is rotatable about a hinge.

7. A mass spectrometry system, comprising:

an ion source;

a housing associated with said ion source and having a panel movable relative to the housing and a window; and a capillary associated with said housing and said window, wherein when said panel is in an open position said window provides a line of sight for viewing and aligning said capillary to a defined position, and when said panel is in a closed position said capillary is aligned within said ion source.

8. The mass spectrometry system of claim 7, further including a conduit through which the capillary extends.

9. The mass spectrometry system of claim 8, wherein the conduit penetrates the housing.

10. The mass spectrometry system of claim 8, wherein a distal end of the conduit is coupled to a gas chromatograph.

11. The mass spectrometry system of claim 8, wherein said conduit has a longitudinal axis, and wherein the longitudinal axis of the conduit is substantially perpendicular to a longitudinal axis of a mass filter in the mass spectometry system, when said panel is closed.

12. The mass spectrometry system of claim 8, wherein said conduit has an end proximal said defined position, wherein said capillary exhibits a protrusion from said proximal end of said conduit, and wherein said window provides a line of sight substantially perpendicular to said protrusion.

13. The mass spectrometry system of claim 7, wherein the window is transparent.

14. The mass spectrometry system of claim 7, wherein the panel is configured to rotate about a hinge.

15. A system for aligning a capillary in an ion source, comprising:

a capillary;

a window for viewing and aligning the capillary; and a movable panel associated with the capillary and window, wherein when said panel is in an open position said window provides a line of sight for viewing and aligning said capillary to a defined position, and when said panel is in a closed position said capillary is aligned within an ion source.

16. The system of claim 15, wherein said ion source is mounted to said panel.

17. The system of claim 16, wherein said panel is configured to rotate about a hinge.

18. The system of claim 16, further including a conduit through which the capillary extends.

19. The system of claim 18, wherein said conduit has an end proximal to said defined position, wherein said capillary exhibits a protrusion from said proximal end of said conduit, and wherein said window provides a line of sight substantially perpendicular to said protrusion.

20. A method of aligning a capillary in an ion source, the method comprising:

removing the ion source from a first location within a housing;

positioning a capillary at a defined location, so that the capillary is aligned in the ion source when the ion source is returned to the first location; and viewing the capillary through a window in the housing, while positioning the capillary.

* * * * *